United States Patent [19]

Lehn

[11] 4,344,641

[45] Aug. 17, 1982

[54] SNOW SKI HAVING AIR CUSHION FORMING UNDERSURFACE

[76] Inventor: Bertold Lehn, Schenebüelweg 1, CH 8240 Thayngen, Switzerland

[21] Appl. No.: 157,485

[22] Filed: Jun. 9, 1980

Related U.S. Application Data

[63] Continuation-in-part of Ser. No. 138,916, Apr. 10, 1980, abandoned.

[30] Foreign Application Priority Data

Apr. 4, 1979 [CH] Switzerland ..... 3513/79
Jul. 17, 1979 [DE] Fed. Rep. of Germany ..... 2928106

[51] Int. Cl.[3] ..... A63C 5/00

[52] U.S. Cl. ..... 280/601; 114/67 A; 244/108; 280/12 R; 280/609; 441/68

[58] Field of Search ..... 280/601, 602, 607, 609, 280/604, 606, 18, 19, 12 H, 12 R; 9/310 A, 310 AA, 310 E, 310 B, 310 C, 310 F; 114/67 A, 67 R, 289, 288, 290; 244/108

[56] References Cited

U.S. PATENT DOCUMENTS

| | | | |
|---|---|---|---|
| 1,812,265 | 6/1931 | Hone | 114/67 A |
| 1,831,697 | 11/1931 | Ziegler | 114/67 A |
| 1,894,256 | 1/1933 | De Ganahl et al. | 114/67 A |
| 2,250,684 | 7/1941 | Svensson | 280/604 |
| 2,382,150 | 8/1945 | Hartman | 9/310 A |
| 3,662,700 | 5/1972 | Roumejon | 114/67 A |
| 3,874,315 | 4/1975 | Wright | 280/604 X |

FOREIGN PATENT DOCUMENTS

| | | | |
|---|---|---|---|
| 200046 | 10/1958 | Austria | 280/601 |

*Primary Examiner*—Joseph F. Peters, Jr.
*Assistant Examiner*—Milton L. Smith
*Attorney, Agent, or Firm*—Howard H. Darbo

[57] ABSTRACT

A ski having lower frictional resistance created by introduction of an air cushion. At least one chamber is formed in the running surface of the ski to hold air which is introduced through an air entrance on the ski. The sides of the chamber are formed to prevent lateral escape of the air. A channel in the form of a Venturi tube extends between the air entrance and the chamber.

2 Claims, 18 Drawing Figures

10
11
12
00

11
12
00
03
05

00
05
03
11

SNOW SKI HAVING AIR CUSHION FORMING UNDERSURFACE

RELATED APPLICATION

This application is a continuation-in-part of Application Ser. No. 138,916, filed Apr. 10, 1980, and entitled SKI, and now abandoned.

The invention relates to a ski. As is well known, the running surface of a ski must be treated or formed in such a way that it is capable of sliding on the snow with as little friction as possible. The measures hitherto known extend to the application of wax, to running surfaces with a plastic coating and running surfaces with fish-scales.

The invention concerns itself with the problem of creating a ski which has a still lower frictional resistance on snow than skis hitherto known and, therefore, permits a greater traveling speed.

The invention solves this problem with a ski which is distinguished in that on the upper and/or the lateral surface of the ski blade there are provided air-entrance openings open toward the traveling direction, which issue through channels arranged in the ski blade in at least one chamber made in the running surface and open downward.

In sufficiently fast travel there forms a sort of air cushion under the ski, which reduces the friction. The air feed can take place either from above or from the side, and also from above and from the side simultaneously.

The essential feature of the present invention is, therefore, that the travel air is supplied to the ski portions lying on the snow in such a way that air cushions form under these portions which exert their effect as long as possible under the ski. A requirement for this is that the air is to be fed to the middle of the ski as seen in longitudinal direction, otherwise the air stream would escape too rapidly in the direction to the sides of the skis.

The field of application of the present invention relates both to cross-country skis and also to downhill skis.

To be sure, with cross-country skis there are not achieved such high traveling speeds that a standing air cushion forms under the running surface that lifts the ski running surface from the ground. The air cushion forming here exerts, however, a supporting action on the ski running surface and simultaneously prevents lumps of snow and ice from adhering to the running surface.

A stronger effect occurs in the case of downhill skis, as at higher traveling speeds an air cushion develops, which carries the ski from underneath, so that comparatively it hovers more over the snow than sides. In any case the two effects simultaneously promote and supplement each other, i.e., at low traveling speeds there forms an air cushion such that icings and adhesions to the running surface are avoided, while at high traveling speeds a supporting air cushion forms on the running surface which further improves the sliding property of this ski to a substantially higher degree.

The formation of air cushions under the running surface of a ski can take place in various manners.

In a first form of the invention, the ski has air feed openings on its surface that issue over obliquely arranged channels made in the ski into a single large chamber that extends over the entire ski in its longitudinal direction, with the exception of laterally arranged air guide strips that prevent too rapid an escape of the air cushion in the direction to the sides of the skis.

In a second form of the invention, the air feed openings are connected with channels, each channel issuing into a separate chamber. Here, the ski is subdivided into ski part sections, in which under each part section a separate air cushion can form. It is, of course, possible to form the cross section and the arrangement of the air cushion-forming chambers under the ski running surface in such a way that in the regions of a high surface pressure under the ski running surface, air cushions of high loading capacity form, while in regions of lower surface pressure the carrying capacity of the air cushion formed there does not need to be so high. The air feed openings can start both on the surface of the ski and also on the lateral face edges of the ski.

For the formation of an air cushion with carrying capacity under the ski running surface it is desired that the air stream flowing through the channel into the chamber on the ski running surface present high velocities. This can be achieved, for example, by use of a Venturi tube. Here, the channel leading from the air-entrance opening on the upper side of the ski to the chamber arranged in the running surface of the ski is formed as a Venturi tube. It consists of a diverging cross section that issues into a converging cross section. The air stream caught by the air-entrance scoop at the air-entrance opening receives, through the formation of the channel as a Venturi tube, a substantial acceleration so that the air stream flowing into the chamber has a higher velocity than the air stream caught by the air-entrance scoop. Here there is achieved the substantial advantage that even at substantially lower traveling speeds a supporting air cushion is formed that considerably improves the sliding properties of the ski.

The inventive idea of the present invention extends not only to the object of the individual patent claims, but also to the combination of the patent claims among one another.

In the following, the invention is explained in detail with the aid of drawings representing merely several embodiments of the invention. From the drawings and their description further substantial advantages and features of the invention can be seen. In the drawings the embodiments of the invention are represented in simplified form.

Figure 1:
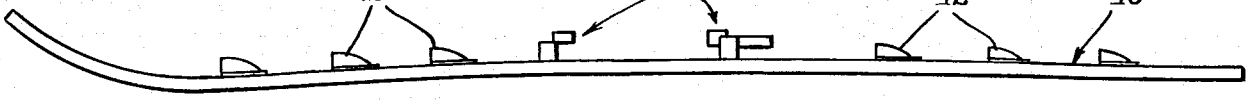
FIGS. 1 to 4 show a ski with air feed openings from above and a single large chamber and, namely, the whole ski from the side, a part longitudinal section, a part view from above and a cross section of the same on a larger scale.
Figure 4:
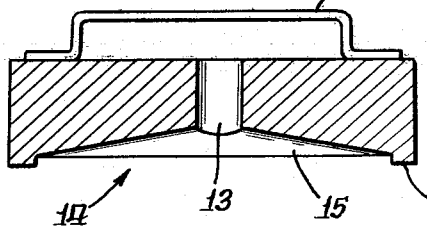
Figure 2:
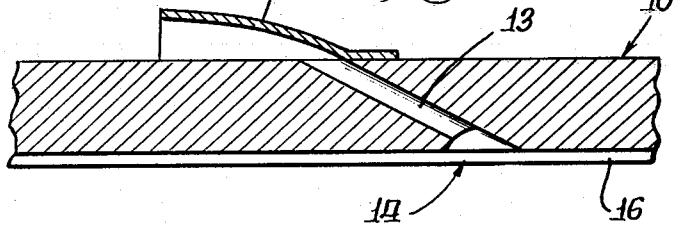
Figure 3:
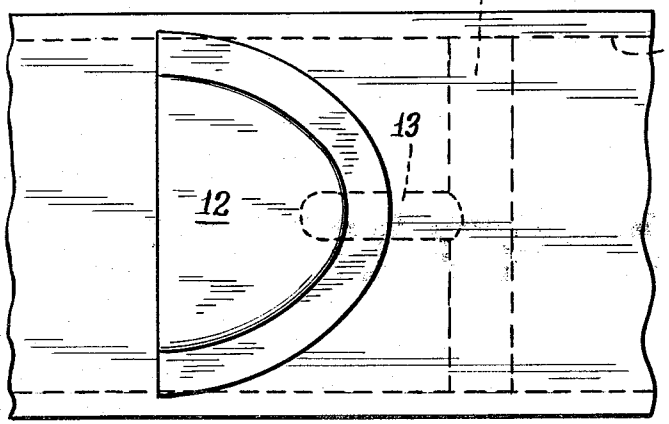

In FIG. 1 the ski is designated with 10; the binding with toe holder and heel holder as a whole is designated with 11.

On top of the ski there are secured six air entrance openings in the form of scoops 12. An oblique bore that passes through the ski from above downward, forms a channel 13 to the chamber 14, which extends over the length of the supporting surface. Where the channels 13 issue into the chamber 14, the entrance opening is widened at 15. The guide strips 16 close off the chamber 14 laterally and simultaneously form a guide for the ski.

Figure 5:
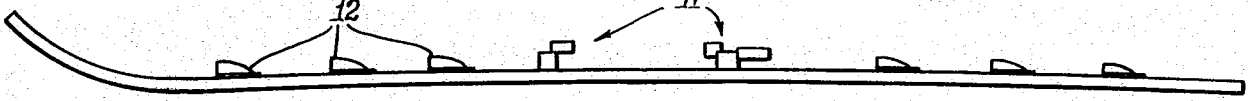
FIGS. 5 to 7 show a ski with air feed openings from above, but with smaller chambers, in side view, part longitudinal section and part view from above.
Figure 6:
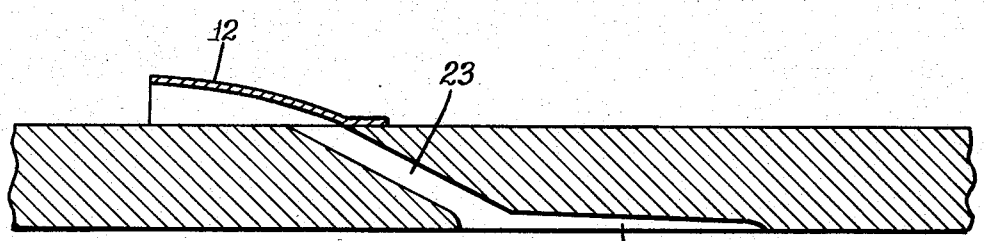
Figure 7:
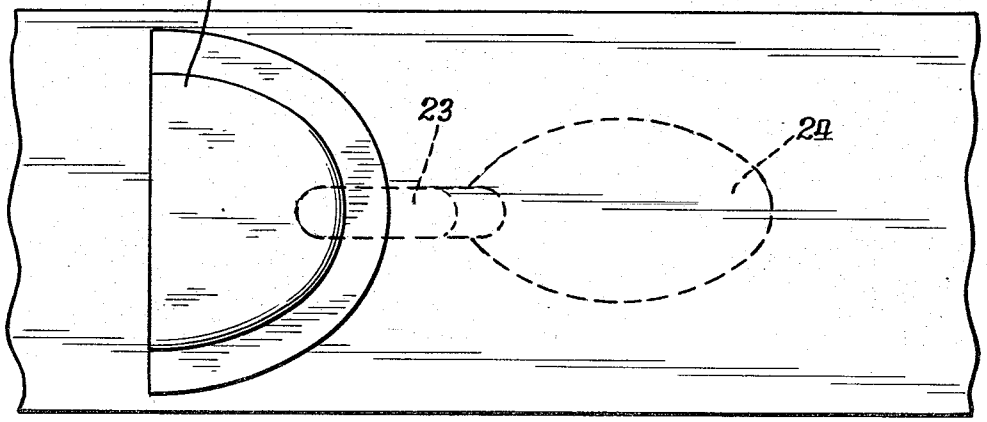

The ski represented in FIGS. 5 to 7 corresponds essentially to the above-described ski, with the difference that here each channel 23 is allocated a smaller chamber 24 of its own. The chambers are made in the running surface of the ski. They are a little deeper on the front side and run at the rear side into a gentle transition to the running surface.

Figure 8:
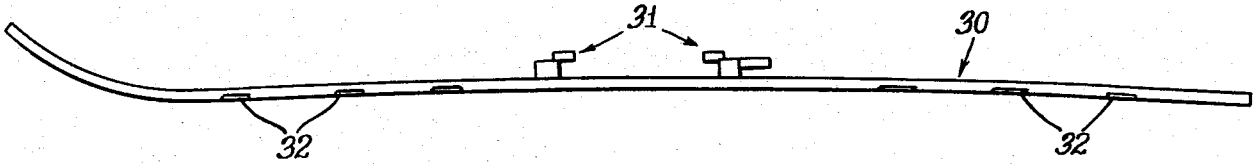
FIGS. 8 to 10 show a ski with air feed openings from the side, in part side view and part view from above.
Figure 9:
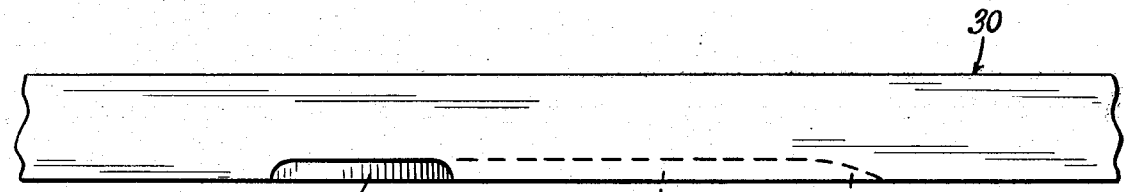
Figure 10:
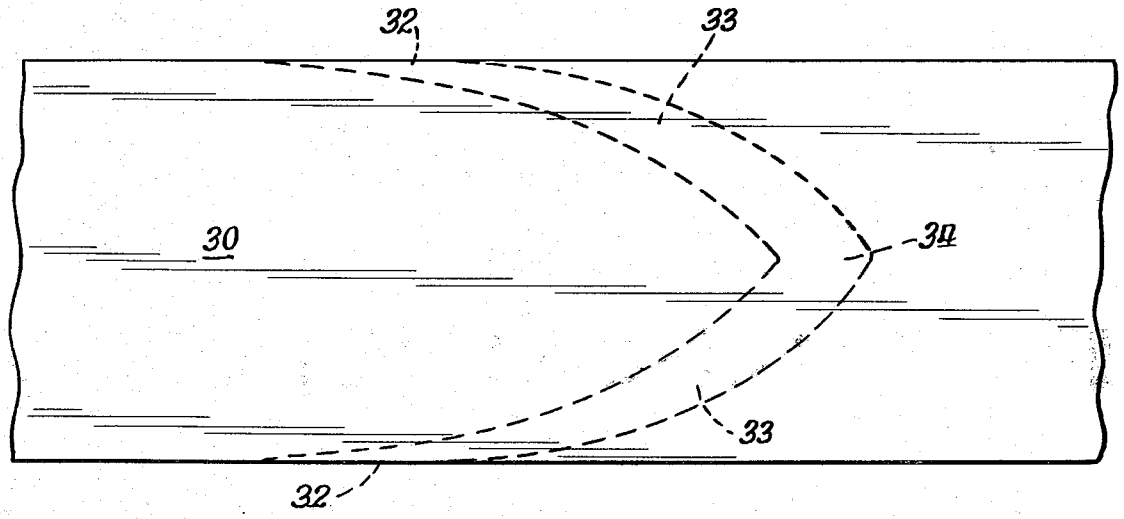

The ski 30 represented in FIG. 8 with its binding 31 has air feed openings 32 made in its lateral surfaces. These openings are formed together with the channels 33 and the chamber 34 as recesses in the running surface of the ski. The channels 32 are gradually widened and, where they come together, form the chamber 34. The channels are curved toward the central longitudinal axis of the ski. FIG. 9 shows a part of the ski on a larger scale from the side with the air-entrance opening 32; FIG. 10 shows the same part in a view from above.

Figure 11:
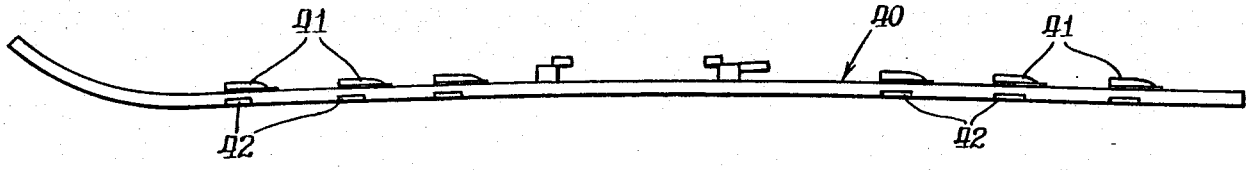
FIGS. 11 to 13 show a ski with air feed openings from above and from the side.
Figure 12:
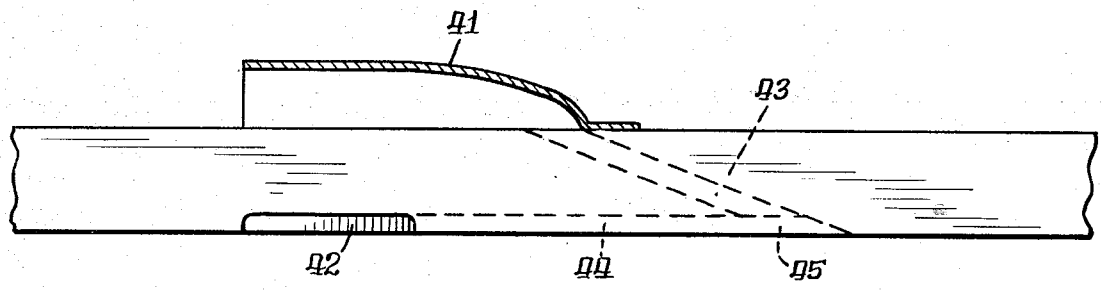
Figure 13:
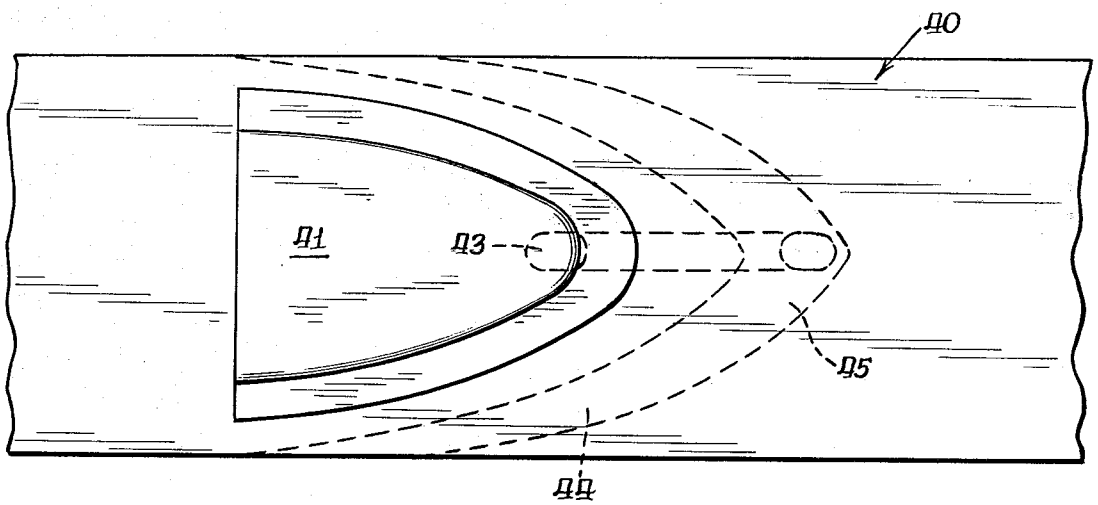
Figure 14:
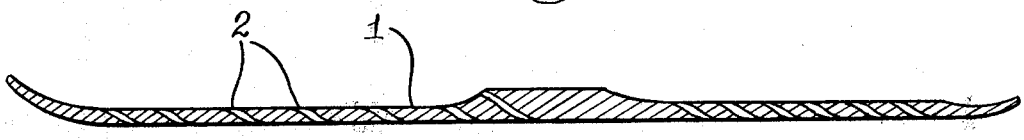
FIGS. 14 to 17 show a ski that is subdivided into part ski elements, with channels formed as Venturi nozzles.
Figure 15:
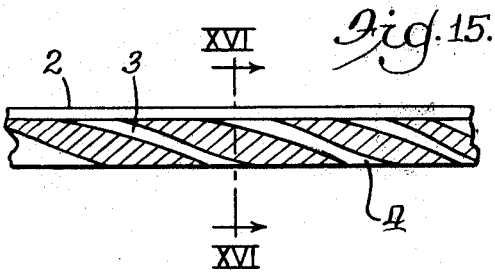
Figure 16:
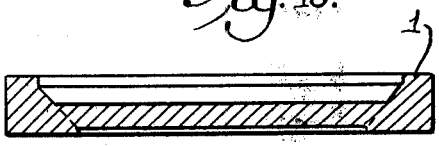

FIGS. 11 to 13, show a combination, in which the ski 40 is provided both with air-entrance scoops 41 on its top surface and also air-entrances 42 made in the side surfaces. A bore 43 forms the feed channel from the scoop 41 to the chamber 45, to which there also lead the channels 44 made in the running surface.

In all the examples of the invention it is essential that the chambers 14, 24, 34, 45 are formed not only somewhat less deep on the back, but that the entry part of the channel 13, 23, 33, 44 is formed in such a way that the air stream is drawn in under the ski through a gentle transition from the channel into the chamber and from the chamber into the running surface of the ski the air stream is drawn in under the ski. In the case of several air cushions forming separately it is hereby provided that the air flowing from the air cushion lying forward in running direction is supplied to the air cushion lying behind it, so that turbulence and flow losses are advantageously avoided. Furthermore, the supporting function of the separately formed air cushions is distributed more uniformly over the entire surface of the running surface.

Figure 17:
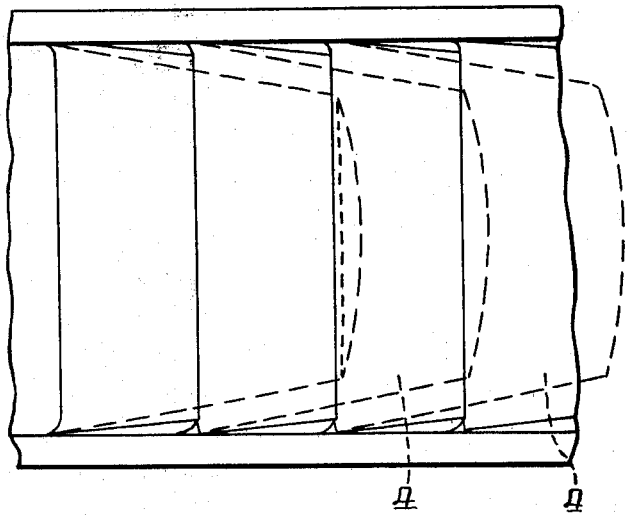

In FIGS. 14 to 17 it is represented that the chambers 4 made in the running surface of the ski blade 1 overlap reciprocally in fish-scale form (see FIG. 17). It is likewise represented that the channels 3 are arranged obliquely in the ski blade 1 in a manner favorable to flow, in which arrangement even an air-entrance scoop such as is shown, for example, scoop 12 in FIG. 1, can be dispensed with. The channels 3 then issue into simply formed air-entrance openings 2.

According to the invention the channel 3 can be formed as a Venturi tube.

Figure 18:
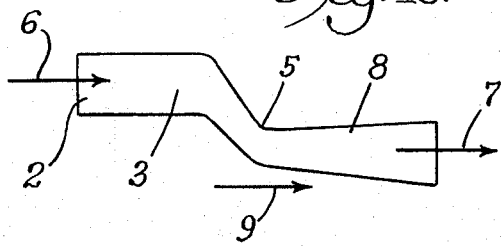
FIG. 18 shows a Venturi nozzle.

With reference to FIG. 18 the functioning of such a Venturi tube is schematically represented. The air flowing into the air-entrance opening 2 in arrow direction 6 passes into a converging section where it is accelerated. After passing through the converging cross section under the narrowest place of this cross section the air stream pases into a diverging cross section 8, where it emerges under the running surface of the ski 1.

In a first form the channel 3 is of the cross section shown in FIG. 18, consisting of a converging cross section 5 and a diverging cross section 8.

In a second form the channel 3 extends only to the narrowest place of the converging cross section 5 and the diverging cross section is formed as a chamber forming the air cushion.

It is essential here that that air accelerated in arrow direction 7 is also sucked along simultaneously in arrow direction 9 under the ski running surface and surfaces to build up an air cushion. That is, through the scale-form overlapping of the individual chambers 4 the air stream flowing in arrow direction 9 from the one chamber to the other chamber is more and more strongly accelerated.

A further important feature of the present invention in all forms is that in turning, therefore with oblique position of the ski, the air cushion effect is suspended and thereby the traveling safety is fully ensured.

I claim:

1. In a ski having upper and side surfaces and a bottom running surface, the improvement comprising (a) at least one chamber formed in the running surface and open downward, said chamber having means at the side surfaces of the ski to substantially prevent lateral escape of air from said chamber when the ski is situated upon a smooth surface, (b) at least one air entrance opening formed in a surface other than the running surface, said opening being open toward the travelling direction for the ski, and (c) a channel communicating said opening to said chamber, said channel comprising a Venturi tube having a converging portion directed toward said opening and a diverging portion open to said chamber.

2. A ski as set forth in claim 1 including a plurality of said chambers overlapping reciprocally in scale form, each chamber having a downstream exit portion converging smoothly at 0° to the running surface.

* * * * *